US005280906A

United States Patent [19]

Vitale

[11] Patent Number: 5,280,906

[45] Date of Patent: Jan. 25, 1994

[54] PERFORMANCE GAME BALL

[76] Inventor: Pasquale M. Vitale, 158 Algiers Dr., Venice, Fla. 34293

[21] Appl. No.: 910,691

[22] Filed: Jul. 8, 1992

[51] Int. Cl.[5] ..... A63B 39/08

[52] U.S. Cl. ..... 273/60 R; 273/58 K; 273/DIG. 20

[58] Field of Search ..... 273/58 R, 58 A, 58 B, 273/58 BA, 58 D, 58 K, 60 R, 60 B, DIG. 20, 65 EF, 232, 233

[56] References Cited

U.S. PATENT DOCUMENTS

| | | | |
|---|---|---|---|
| 922,773 | 5/1909 | Kempshall | 273/232 |
| 1,150,761 | 8/1915 | Hartman | 273/58 K |
| 2,135,210 | 11/1938 | Farrar | 273/232 |
| 2,776,139 | 1/1957 | Blamey | 273/58 B |
| 4,128,238 | 12/1978 | Newcomb | 273/26 R |
| 4,184,682 | 1/1980 | Collins | 273/106 B |
| 4,871,169 | 10/1989 | Autorino | 273/26 R |
| 4,874,169 | 10/1989 | Litchfield | 273/60 R |
| 4,887,814 | 12/1989 | Winter | 273/58 K |
| 4,919,422 | 4/1990 | Ma | 273/26 R |
| 4,930,776 | 6/1990 | Newcomb et al. | 273/58 B |
| 5,033,743 | 7/1991 | Wright | 273/58 K |
| 5,158,284 | 10/1992 | Vogl | 273/60 B |

*Primary Examiner*—Vincent Millin
*Assistant Examiner*—Steven B. Wong
*Attorney, Agent, or Firm*—Bromberg & Sunstein

[57] ABSTRACT

A game ball for throwing has a top hemisphere (12) provided with a plurality of apertures (16) which attract air into a hollow spherical shell (10). The bottom hemisphere (14) is of an imperforate nature, and is provided with a plurality of air channels (20) positioned parallel to and subsequently away from an equatorial line (22). When projected along the plane of the equatorial line (22), the ball will deviate from a normal trajectory in the direction of the axis of the bottom hemisphere (26).

22 Claims, 2 Drawing Sheets

PERFORMANCE GAME BALL

BACKGROUND

1. Field of Invention

This invention relates to game balls, specifically to such balls which are adapted to curve.

2. Description of Prior Art

The game of WIFFLE® ball, which uses the ball described and claimed in U.S. Pat. No. 2,776,139 to Blamey and Mullany (1957), has evolved into tournament structured competitions, which attract the better players of the sport. (WIFFLE® is a trademark of Wiffle Ball, Inc., Shelton, Conn. Wiffleball, although WIFFLE® ball able to be used in a small playing area, and safe for participants to use, does not produce the desired professional "ball movement" it claims, unless it is physically altered. This is recognized by uninitiated players who attempt to throw a new WIFFLE® ball "right out of the box".

Professional WIFFLE® ball pitchers overcome this problem in a variety of ways, the most common of which is to use sandpaper to scuff or scratch the ball. Others have become more exotic in their approach, by also soaking their WIFFLE® ball in ice water before using them in competition.

This art of doctoring a Wiffleball places unknowledgeable players at a distinct disadvantage. It also dictates that only older balls, often marked, torn, or out of round, will be able to be used effectively. This greatly hinders the development of the sport, and results in a situation of unfair competition.

The WIFFLE® ball and others such as those described in U.S. Pat. Nos. 4,919,422 to Ma (1990), 4,871,169 to Autorino et al. (1989), and 4,128,238 to Newcomb et al. (1978), all rely on the principles of "aerodynamic drag" or wind resistance, which at best, produce marginal results.

OBJECTS AND ADVANTAGES

Accordingly, several objects and advantages of the game ball of the present invention are:

(a) to provide a game ball which can curve or break consistently in a professional manner, while being thrown with relative ease.

(b) to provide a game ball which can be used in competition without the need of altering it in any way, thus keeping newer balls in play at all times.

(c) to provide a game ball which can be used at different levels of play, without allowing any hidden advantage.

(d) to provide a game ball which can be used as an instructional tool for hitters.

(e) to provide a game ball which is safe for participants of all ages.

(f) to provide a game ball which can be manufactured inexpensively.

Further objects and advantages of my invention will become apparent from a consideration of the drawings and ensuing description.

DRAWING FIGURES

Reference Numerals In Drawings

Figure 1:
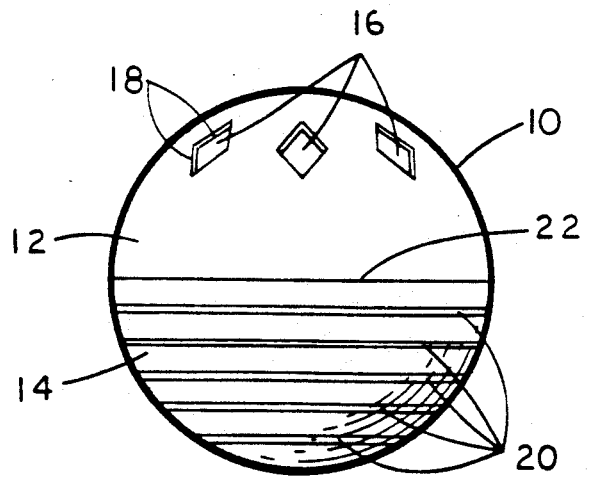
FIG. 1 is a side view of the preferred embodiment of the game ball.

10 hollow spherical shell
12 top hemisphere
14 bottom hemisphere
16 apertures
18 beveled edges
20 air channels
22 equatorial line
24 surface ridges
26 axis of the bottom hemisphere
28 spiral ridge

DESCRIPTION-FIGS. 1 to 7

The preferred embodiment of the game ball of the present invention is illustrated in FIG. 1. In the drawings, the game ball comprises a hollow spherical shell 10, substantially the same size as a regulation baseball. While this size is disclosed for the purposes of this description, it may also be any suitable size, as for example, that of a smaller practice baseball, or a larger, regulation softball. The shell 10 is preferably made of plastic material, such as polyethylene or the like, and is molded into the desired shape. The shell 10 consists of two distinctly different hemispheres and may be manufactured as one sphere, or as two semispheres which are joined together. The top hemisphere 12 of the hollow spherical shell 10 is provided with a series of cutouts or apertures 16 which are evenly spaced around the top hemisphere 12 and evenly distant from the equatorial line 22. It is preferable that the present invention have eight diamond shaped apertures 16 of the same size, approximately 12 mm in length and 8 mm in width. Other embodiments may be provided with apertures 16 of varying size and/or shape, at varying distances from the equatorial line 22. The function of the apertures 16 is to attract air into the hollow spherical shell 10. This function is made more effective by the provision of beveled edges 18 at all sides of the apertures 16, which allow air to flow more easily into the hollow spherical shell 10. An imperforate bottom hemisphere 14 is provided with a series of five air channels 20, in the form of grooves, which are positioned parallel to the equatorial line 22. It is the function of the air channels 20 to direct air flow in a manner which causes the bottom hemisphere 14 to stabilize the game ball in flight.

Figure 2:
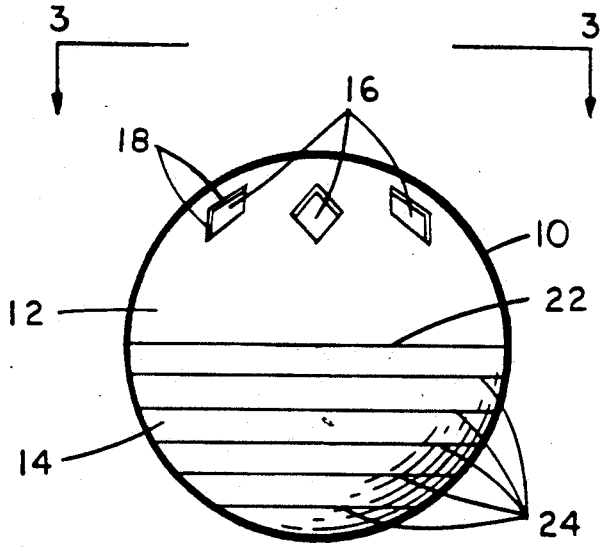
FIG. 2 is a side view of another embodiment of the game ball.

FIG. 2 shows an alternate form of the game ball of the present invention. It is identical to and allows the same variations as that of the preferred embodiment shown in FIG. 1, with the exception that the air channels 20 of the bottom hemisphere 14 are defined by the proximity of surface ridges 24. Under certain atmospheric conditions, the embodiment of the game ball depicted in FIG. 2 may be preferred.

Figure 3:
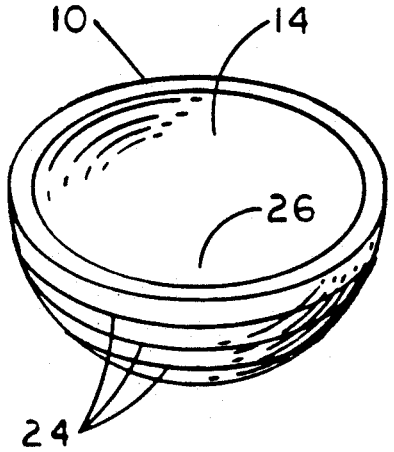
FIG. 3 is a perspective view of the bottom hemisphere of the game ball taken from above.

FIG. 3 shows the bottom half of the hollow spherical shell 10. The embodiment shown in this figure is provided with five surface ridges 24, which form four air channels 20 positioned parallel to the equatorial line 22.

Figure 4:
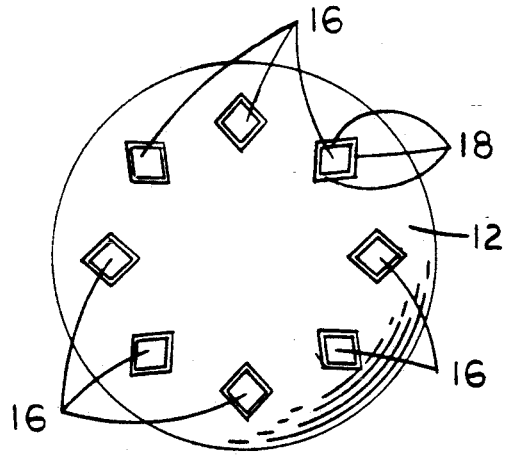
FIG. 4 is a plane view of the game ball taken from above.

FIG. 4 shows the top hemisphere 12 of the preferred embodiment of the game ball, which is provided with eight apertures 16, evenly spaced, and evenly distant from the equatorial line 22.

Figure 5:
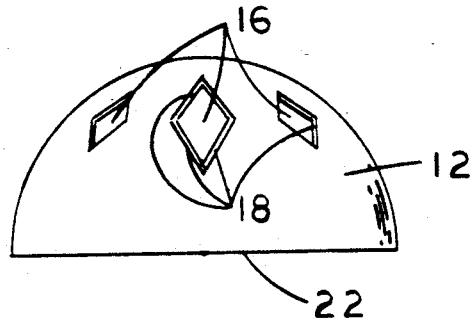
FIG. 5 is a side view of an alternate form of the top hemisphere of the game ball.

FIG. 5 shows an alternate form of the top hemisphere 12 of the game ball of the present invention. It differs from that depicted in FIGS. 1 and 2, in that it shows apertures 16 of varying size positioned at different distances from the equatorial line 22. This embodiment allows for the adjustment of air intake into the hollow spherical shell 10, which regulates the degree to which the game ball will deviate from a normal flight path.

Figure 6:
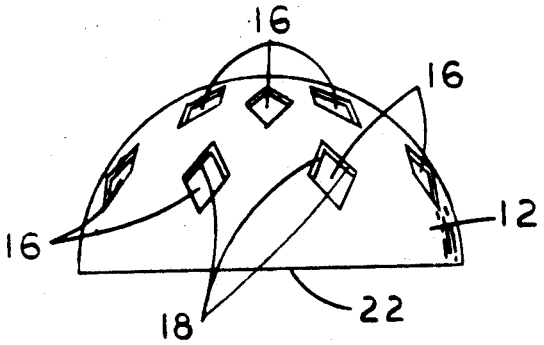
FIG. 6 is a side view of another alternate form of the top hemisphere of the game ball.

FIG. 6 shows another alternate form of the top hemisphere 12 of the game ball of the present invention. It differs from the forms depicted in FIGS. 1, 2, 4, and 5 in that it shows a plurality of apertures 16 at varying distances from the equatorial line 22. Although, for purposes of description, the apertures 16 are depicted as being the same size and shape, it remains possible that size and/or shape may vary.

Figure 7:
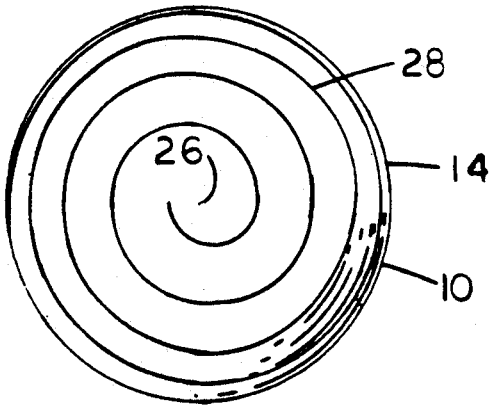
FIG. 7 is a plane view of the bottom hemisphere taken from below.

FIG. 7 shows an alternate form of the bottom hemisphere 14 of the game ball of the present invention, in which a series of air channels 20 is replaced with a singular spiral ridge 28, commencing at or near the equatorial line 22, and terminating at or near the axis of the bottom hemisphere 26.

Theory of Operation

The game ball of the present invention utilizes a theory of operation which is believed to be in direct opposition to that of any prior art.

As previously mentioned, all other attempts at designing a ball which will curve or break in a manner similar to that of a skilled baseball pitcher, have been predicated on the principle of "aerodynamic drag" or wind resistance.

The game ball of the present invention replicates skilled pitching by "attracting" air into the ball through apertures, which are provided with beveled edges to facilitate the flow of air into the hollow spherical shell. What happens next can best be likened to the principle of "parachuting". The air that enters the ball "pushes" the inside of the solid imperforate hemisphere away in the direction of the axis of the bottom hemisphere. The air channels of the bottom hemisphere further assist the game ball in this direction by "biting" into the wind, and by stabilizing the game ball along its projected pattern of flight.

Operation

The manner of throwing the performance game ball incorporates some of the mechanics of throwing a baseball, but excludes any twisting or rotating of joints, which often results in injury.

The basic grip is achieved by placing the ball in the pitching hand, and splitting the equatorial line 22 of the game ball with the index and middle fingers, in a manner which is similar to that of a baseball pitcher attempting to throw a curve ball.

There are four basic pitches that are commonly thrown, although a pitcher of greater skill may combine two of the described pitches to create a combination pitch. For the purposes of the description of operation, all pitches are detailed as if thrown by a right-handed player.

To throw a curve ball, a pitch that technically breaks downward:

1. Employ the basic grip, and position game ball so that the axis of the bottom hemisphere 26 faces right, and conversely that of the top hemisphere 12 faces left.

2. Throw ball in a normal sidearm motion toward the intended target, keeping the bottom hemisphere 14 facing down, and the top hemisphere 12 facing up. Air will rush into the apertures 16 on top, and assisted by the air channels 20, will push the ball downward.

To throw a rising fastball, a pitch that will break upward:

1. Employ the basic grip, and position game ball so that the axis of the bottom hemisphere 26 faces left, and conversely that of the top hemisphere 12 faces right.

2. Throw ball in a normal sidearm motion toward the intended target, keeping the bottom hemisphere 14 facing up, and the top hemisphere 12 facing down. Air will rush into the apertures 16 on the bottom, and assisted by the air channels 20, will "parachute" the ball upward.

To throw a slider, a pitch that breaks toward the left:

1. Employ the basic grip, and position game ball so that the axis of the bottom hemisphere 26 faces left, and conversely that of the top hemisphere 12 faces right.

2. Throw ball in a straight overhand motion toward the intended target, keeping the bottom hemisphere 14 facing left and the top hemisphere 12 facing right. Air will rush into the apertures 16 on the right, and assisted by the air channels 20, will "parachute" the ball toward the left.

To throw a reverse slider, or a screwball, a pitch that breaks toward the right:

1. Employ the basic grip, and position game ball so that the axis of the bottom hemisphere 26 faces right, and conversely that of the top hemisphere 12 faces left.

2. Throw ball in a straight overhand motion toward the intended target, keeping the bottom hemisphere 14 facing right and the top hemisphere 12 facing left. Air will rush into the apertures 16 on the left, and assisted by the air channels 20, will "parachute" the ball toward the right.

The reader should note that the game ball always breaks in the direction of the axis of the bottom hemisphere 26. Accordingly, combination pitches may be achieved by experimenting with the positioning of the game ball in the pitching hand, and by modifying the point at which the game ball is released.

Summary, Ramifications, and Scope

Thus, the reader will see that the game ball of the present invention, manufactured of a lightweight material, can be used by players of all ages without concern for bodily harm or damage to property. Also, the nature of the intended material is to produce a restricted flight of a batted ball, requiring a smaller playing area.

The method of throwing the performance game ball is relatively simple, and requires no twisting or rotating of joints, which may be suseptible to injury.

The design and theory of operation of the game ball also provide consistent results, which lead to a development of pitching skill and a situation of fair competition. Also, the fact that the game ball performs as intended when it is new, eliminates the need to physically alter it in any way.

While the description above contains many specificities, these should not be construed as limiting the scope of the invention, but merely providing illustrations of some of the presently preferred embodiments of this invention. For example, the apertures may have other shapes, such as oval, triangular, trapezoidal, circular, etc.; the number of air channels may be as few as one or a number greater than that of the preferred embodiment; the color of the ball may be of the nature which glows in the dark, or multicolored for additional appeal; the size and number of apertures may also be different than that of the preferred embodiment, allowing for an adjustment of the desired curve or break.

Thus, the scope of the invention should be determined by the appended claims and their legal equivalents, rather than by the examples given.

I claim:

1. A ball for throwing in a curved flight path, comprising a hollow shell of generally spherical shape, including a pair of complementary hemispherical portions joined along a generally equatorial line, one of said pair provided with a plurality of apertures, and the other of said pair being imperforate in nature, and provided with a plurality of air channels positioned substantially parallel to and spaced away from away from said equatorial line.

2. The game ball of claim 1 wherein said shell is made of plastic.

3. The game ball of claim 1 wherein said apertures are diamond shaped.

4. The game ball of claim 1 wherein said apertures are evenly spaced, and evenly distant from said equatorial line.

5. The game ball of claim 1 wherein said apertures are unevenly spaced, and unevenly distant from said equatorial line.

6. The game ball of claim 1 wherein said apertures are provided with beveled edges.

7. The game ball of claim 1 wherein said air channels are defined by subsurface grooves.

8. The game ball of claim 1 wherein said air channels are defined by a plurality of surface ridges mounted on the imperforate hemispherical portion.

9. The game ball of claim 1 wherein the apertures and air channels are arranged so that, when said ball is thrown in a direction parallel to a diameter passing through said equatorial line, said ball breaks towards said imperforate hemispherical portion.

10. A ball for throwing in a curved flight path, comprising a hollow sheel of generally spherical shape, including a pair of complementary hemispherical portions joined along a generally equatorial line, one of said pair provided with a plurality of apertures, and the other of said pair being imperforate in nature, and provided with an air channel.

11. The game ball of claim 10 wherein said air channel is defined by a subsurface groove, and is positioned substantially parallel to said equatorial line.

12. The game of claim 10 wherein said air channel is defined by a pair of surface ridges, and is positioned substantially parallel to said equatorial line.

13. The game ball of claim 10 wherein said air channel is of a spiraling nature, commencing approximately at said equatorial line and terminating at a point on the imperforate hemispherical portion further from said equatorial line than where the air channel commences.

14. The game ball of claim 10, wherein the apertures and the air channel are arranged so that, when said ball is thrown in a direction parallel to a diameter passing through said equatorial line, said ball breaks in the direction of the imperforate hemispherical portion.

15. A ball for throwing in a curved flight path comprising a hollow shell of generally spherical shape, including a pair of complementary hemispherical portions joined along a generally equatorial line, one of said pair provided with a plurality of apertures, and the other of said pair being imperforate in nature, and provided with a surface ridge.

16. The game ball of claim 15 wherein said surface ridge is positioned substantially parallel to said equatorial line.

17. The game ball of claim 15 wherein said surface ridge is of a spiraling nature, commencing approximately at said equatorial line, and terminating at a point on the imperforate hemispherical portion further from said equatorial line than where the surface ridge commences.

18. The game ball of claim 15, wherein the apertures and the surface ridge are arranged so that, when said ball is thrown in a direction parallel to a diameter passing through said equatorial line, said ball breaks in the direction of the imperforate hemispherical portion.

19. A ball for throwing in a curved flight path, comprising a hollow sheel of generally shperical shape, including first and second portions joined along a circle, the first portion provided with a plurality of apertures, and the second portion being imperforate in nature, and provided with an air channel aligned substantially parallel to an spaced away from away from the circle, wherein the apertures and the air channel are arranged so that, when said ball is thrown in a direction parallel to a diameter passing through said equatorial line, the ball breaks in the direction of the second portion.

20. A ball according to claim 19, wherein the first portion has a substantially smooth surface.

21. A ball according to claim 19, wherein each of the portions has a point furthest from the circle, the ball has an axis passing through both of these points, and the air channel is arranged so as to substantially encircle the axis.

22. A method of throwing a ball that breaks in a desired direction, the method comprising the steps of:

providing a ball having a hollow shell of generally spherical shape, including first and second portions joined along a circle, the first portion provided with a plurality of apertures, and the second portion being imperforate in nature, and provided with an air channel aligned substantially parallel to and spaced away from away from the circle;

gripping the ball so that a first finger is located on the first portion and a second finger is located on the second portion; and throwing the ball so that the second portion is oriented in the desired direction of breaking and so that the ball is thrown in a direction parallel to a diamater passing through the circle.

* * * * *